US006966953B2

(12) United States Patent
Liu et al.

(10) Patent No.: US 6,966,953 B2
(45) Date of Patent: Nov. 22, 2005

(54) MODIFIED SINTERED RE-FE-B-TYPE, RARE EARTH PERMANENT MAGNETS WITH IMPROVED TOUGHNESS

(75) Inventors: Shiqiang Liu, Dayton, OH (US); Jinfang Liu, Lancaster, PA (US)

(73) Assignees: University of Dayton, Dayton, OH (US); Electron Energy Corporation, Landisville, PA (US)

( * ) Notice: Subject to any disclaimer, the term of this patent is extended or adjusted under 35 U.S.C. 154(b) by 220 days.

(21) Appl. No.: 10/292,979

(22) Filed: Nov. 13, 2002

(65) Prior Publication Data

US 2003/0201035 A1 Oct. 30, 2003

Related U.S. Application Data

(60) Provisional application No. 60/376,218, filed on Apr. 29, 2002.

(51) Int. Cl.[7] ..... H01F 1/057

(52) U.S. Cl. ..... 148/302; 420/83; 420/121; 75/244

(58) Field of Search ..... 148/302; 420/83, 420/121; 75/244

(56) References Cited

U.S. PATENT DOCUMENTS

| | | | |
|---|---|---|---|
| 3,558,372 A | 1/1971 | Becker | |
| 4,402,770 A | 9/1983 | Koon | |
| 4,533,408 A | 8/1985 | Koon | |
| 4,597,938 A | 7/1986 | Matsuura et al. | |
| 4,710,239 A | 12/1987 | Lee et al. | |
| 4,770,723 A | 9/1988 | Sagawa et al. | |
| 4,773,950 A | 9/1988 | Fujimura et al. | |
| 4,859,410 A | 8/1989 | Brewer et al. | |
| 4,975,130 A | 12/1990 | Matsuura et al. | |
| 5,110,377 A | 5/1992 | Yamamoto et al. | |

FOREIGN PATENT DOCUMENTS

| | | | |
|---|---|---|---|
| EP | 0 124 655 A1 * | 11/1984 | |
| JP | 61-147504 * | 7/1986 | ..... 148/302 |
| JP | 3-236202 * | 10/1991 | ..... 75/245 |
| JP | 5-74618 * | 3/1993 | ..... 148/302 |
| JP | 5-315119 * | 11/1993 | ..... 148/121 |

OTHER PUBLICATIONS

Sagawa, M. et al., "New material for permanent magnets on a base of Nd and Fe", Journal of Applied Physics, 55(6), pp. 2083–2087, Mar. 15, 1984.

Sawaga, M. and Nagata, H., "Novel Processing Technology for Permanent Magnets" IEEE Transactions on Magnetics, vol. 29, No. 6, pp. 2747–2751, Nov. 1993.

Koon, N.C. and Das, B.N., "Crystallization of FeB alloys with rare earths to produce hard magnetic materials" Journal of Applied Physics, 55(6), pp. 2063–2066, Mar. 15, 1984.

Takahashi, M. et al., "High performance Nd–Fe–B sintered magnets made by the wet process" Journal of Applied Physics, vol. 83, No. 11, pp. 6402–6404, Jun. 1, 1998.

Croat, J.J. et al., "Pr–Fe and Nd–Fe–based materials: A new class of high–performance permanent magnets" Journal of Applied Physics, 55(6), pp. 2078–2082, Mar. 15, 1984.

Lee, R.W., "Hot–Pressed neodymium–iron–boron magnets" Appl. Phys. Lett., 46(8), pp. 790–791, Apr. 15, 1985.

(Continued)

*Primary Examiner*—John P. Sheehan
(74) *Attorney, Agent, or Firm*—Dinsmore & Shohl LLP

(57) ABSTRACT

Compositionally modified, sintered RE-Fe—B-based rare earth permanent magnets demonstrate the optimum combination of mechanical and magnetic properties, thereby maximizing fracture toughness with corresponding improved machinability, while maintaining the maximum energy product $(BH)_{max}$.

6 Claims, 9 Drawing Sheets

OTHER PUBLICATIONS

Givord, D. et al., "Magnetic Properties and Crystal Structure of $Nd_2Fe_{14}B$" Solid State Communications, vol. 50, No. 6, pp. 497–499, 1984.

Croat, J.J. et al., "High energy product Nd–Fe–B permanent magnets" Appl. Phys. Lett., 44(I), pp. 148–149, Jan. 1, 1984.

Hirosawa, S. and Kaneko, Y., "Rare Earth Magnets with High Energy Products" in Proceedings of the 15th International Workshop on Rare Earth Magnets and Their Applications, vol. 1, pp. 43–53, 1998.

Mishra, Microstructure of Melt–Spun Nd–Fe–B Magnequench Magnets, Journal of Magnetism and Magnetic Materials 54–57 (1986) pp. 450–456.

Sagawa, M. et al., Permanent Magnet Materials Based on the Rare Earth–Iron–Boron Tetragonal Compounds (Invited), IEEE Transactions of Magnetics, vol. Mag–20, No. 5, Sep. 1984, pp. 1584–1589.

Herbst, J.F. et al., Relationships between crystal structure and magnetic properties in $Nd_2Fe_{14}B$ , Physical Review B, vol. 29, No. 7, Apr. 1, 1984, pp. 4176–4178.

Herbst, J.F., $R_2Fe_{14}B$ materials: Intrinsic properties and technological aspects, Reviews of Modern Physics, vol. 63, No. 4, Oct. 1991, pp. 819–898.

* cited by examiner

Dimensions of Charpy impact specimen (A = 0.250" ± 0.002", B = 0.563" ± 0.04", C = 1.125" ± 0.08", D = 0.010R ± 0.002", and E = 0.322" + 0, - 0.002").

MODIFIED SINTERED RE-FE-B-TYPE, RARE EARTH PERMANENT MAGNETS WITH IMPROVED TOUGHNESS

CROSS-REFERENCE TO RELATED APPLICATION

This application is related to commonly owned, copending application entitled "METHOD OF IMPROVING TOUGHNESS OF SINTERED RE-Fe—B-TYPE, RARE EARTH PERMANENT MAGNETS," Ser. No. 10/293,680, filed Nov. 13, 2002, the disclosure of which is hereby incorporated by reference.

BACKGROUND OF THE INVENTION

Since their commercial introduction in the mid-1980s, applications for rare earth-iron-boron magnets have continued to grow and this material has become a major factor in the global rare earth permanent magnet market. Among commercially available permanent magnets, $Nd_2Fe_{14}B$ type magnets offer the highest maximum energy product $(BH)_{max}$ ranging from 26 to 48. Experimental versions have reported a $(BH)_{max}$ in excess of 55 $MGO_e$.

$Nd_2Fe_{14}B$ rare earth magnets exhibit the highest room temperature magnetic properties, which is the basis for the wide use. As noted above, high performance $Nd_2Fe_{14}B$-based permanent magnets provide high maximum energy products $(BH)_{max}$. In addition, they offer large saturation magnetization ($4\pi M_S$) and high intrinsic coercivity ($_MH_C$). That the Nd—Fe—B-type permanent magnets continue to offer the most promise for high magnetic performance rare earth permanent magnets is evident from FIG. 1.

Unfortunately, the $Nd_2Fe_{14}B$ rare earth permanent magnets are notoriously brittle and susceptible to oxidation. Chipping, cracking and fracture often occur during grinding, assembly and even during operation of conventional $Nd_2Fe_{14}B$ magnets. The fact that since these magnets cannot be machined and/or drilled imposes serious limitations on the shapes and uses available. The reject rate in production attributed to brittleness/lack of toughness runs generally from 10 to 20% and, on occasion, reaches 30%. The poor fracture toughness of current rare earth permanent magnets is illustrated in FIG. 2.

All sintered rare earth permanent magnets, $SmCo_5$, $Sm_2Co_{17}$, and $Nd_2Fe_{14}B$, are brittle due to the intrinsically brittle intermetallic compounds used for these magnets. Machinable permanent magnets include:

(a) Fe—Cr—Co-type, which unfortunately exhibit low magnetic-performance, (b) Pt—Co-type which are too expensive, and (c) Bonded permanent magnets that exhibit dramatically reduced performance, i.e. loss of up to 50% magnetic performance comparing to their sintered counterparts.

Improvement in the fracture toughness of the class of rare earth permanent magnets of the REFeB-type, while maintaining their high: $4\pi M_S$, $_MH_C$, and $(BH)_{max}$, would not only improve their manufacturing efficiency and machinability, but it would also expand the market for this class of permanent magnets, by offering opportunities for new applications, new shapes, new uses, lower costs, etc.

Relevant prior art in this area includes: U.S. Pat. Nos. 4,402,770; 4,597,938; 4,710,239; 4,770,723; 4,773,950; 4,859,410; 4,975,130 and 5,110,377. Additional references include U.S. Pat. Nos. 3,558,372 and 4,533,408. Relevant literature references include:

M. Sagawa, S. Fujimura, N. Togawa, H. Yamamoto, and Y. Matsuura, "New material for permanent magnets on a base of Nd and Fe", Journal of Applied Physics, volume 55, pp. 2083–2087, 1984;

Y. Kaneko and N. Ishigaki, "Recent developments of high-performance NEOMAX magnets", JMEPEG, VOLUME 3, PP. 228–233, 1994;

M. Sagawa and H. Nagata, "Novel processing technology for permanent magnets" IEEE Trans. Magn. Volume 29, pp. 2747–2752, 1993;

S. Hirosawa and Y. Kaneko, "Rare earth magnets with high energy products" in Proceedings of the $15^{th}$ international Workshop on Rare Earth Magnets and Their Applications, volume 1, pp. 43–53, 1998;

M. Takahashi, et al, "High performance Nd—Fe—B sintered magnets made by the wet process", J. Appl. Phys., volume 83, pp. 6402–6404, 1998;

J. J. Croat, J. F. Hebst, R. W. Lee, and F. E. Pinkerton, "Pr—Fe and Nd—Fe based materials: A new class of high performance permanent magnets", J. Appl. Phys. Vol. 55, pp. 2078–2082, 1984;

J. F. Herbst, "R2Fe14B materials: Intrinsic properties and technological aspects", Rev. Mod. Phys. Vol. 63, pp. 819–898, 1991;

Croat et al, "Pr—Fe and Nd—Fe-based Materials: A New Class of High-Performance . . . ", J. Appl. Phys., 55(6), Mar. 15, 1984;

Sagawa et al, "New Material for Permanent Magnets on a Base of Nd and Fe", J. Appl. Phys. 55(6), Mar. 15, 1984;

Koon et al, Crystallization of FeB Alloys with . . . "J. Appl. Phys. 55(66), Mar. 15, 1984;

Stadelmaier, "The Neodymium-Iron Permanent Magnet Breakthrough", MMPA Workshop, January 1984;

Japanese High Technology, "Request for New Magnetic Material . . . ", vol. 4, No. 5, Aug. 1984;

"Neomax—Neodymium-Iron-Magnet", Sumitomo Special Metals Co., Ltd. Lee, "Hot-Pressed Neodymium-Iron-Boron Magnets", Appl. Phys. Lett. (46(8) Apr. 15, 1985;

R. K. Mishra, "Microstructure of Melt-Spun Neodymium-Iron-Boron Magnets", International Conference on Magnetism, 1985;

Sagawa et al., "Permanent Magnet Materials Based on the Rare Earth-Iron-Boron Tetragonal Compounds", The Research Institute for Iron, Steel and Other Metals, Tohoku University, Japan;

Givord et al., "Magnetic Properties and Crystal Structure of $R_2Fe_{14}B$", Solid State Comm., vol. 50. No. 6, February 1984, pp. 497–499;

Herbst et al., "Relationships Between Crystal Structure and Magnetic Properties in $R_2Fe_{14}B$", Phys. Dept., General Motors Res. Lab., pp. 1–10; and Croat et al., "High-Energy Product Nd—Fe—B Permanent Magnets", App. Phys. Lett., 44(1), Jan. 1, 1984, pp. 148–149.

Various rare earth permanent magnets can be formed by pressing and sintering the powder or by bonding with plastic binders. Sintered $Nd_2Fe_{14}B$ parts produce the highest magnetic properties. Unfortunately, $Nd_2Fe_{14}B$ magnets are sensitive to heat and normally cannot be used in environments that exceed 150° C.

Compared to the SmCo 1:5 and 2:17 magnets, $Nd_2Fe_{14}B$ magnets have an excellent value in terms of price per unit of $(BH)_{max}$. Small shapes and sizes with high magnetic fields are one of the attractive features of $Nd_2Fe_{14}B$ magnets. Today's commercial $Nd_2Fe_{14}B$-based magnets include combinations of partial substitutions for Nd and Fe, leading to a wide range of available properties.

Several different techniques are used to produce $Nd_2Fe_{14}B$-based magnets. One method is similar to that used for ceramic ferrite and sintered Sm—Co magnets. The alloys with appropriate composition are induction melted to ingots, which are then crushed and milled to powders of a few microns. The powder is formed into a desired shape by pressing under alignment field. The pressed green compacts are then sintered to full density and heat treated to obtain suitable magnetic properties.

A second process involves rapid quenching of a molten $Nd_2Fe_{14}B$-based alloy, using a "melt spinning" technique to produce ribbons, which are then milled to powder. While the crushed ribbon yields relatively large platelet-shaped powder particles, rapid quenching provides them with an extremely fine microstructure having grain boundaries that deviate from the primary $Nd_2Fe_{14}B$ composition. Rapidly quenched powder is inherently isotropic. However, it can be consolidated into a fully dense anisotropic magnet by the plastic deformation that occurs in hot pressing. The fine microstructure makes this powder very stable against oxidation, making it easy to blend and form into a wide range of isotropic bonded magnets.

$Nd_2Fe_{14}B$ powder tends to readily absorb hydrogen, which degrades the material into a very brittle powder. This response to hydrogen renders the powder more amenable to milling and is the basis for the hydrogenation, disproportionation, desorption and recombination process generally referred to as HDDR. The HDDR process provides $Nd_2Fe_{14}B$ powder with an ultrafine structure with grains about the size of a single domain. Such HDDR powder can be hot pressed into a fully dense anisotropic magnet, or it can be blended and molded into an anisotropic bonded magnet.

SUMMARY OF THE INVENTION

Disclosed are compositionally modified, sintered RE-Fe—B-type rare earth permanent magnets that demonstrate the optimum combination of mechanical and magnetic properties, thereby maximizing fracture toughness with corresponding improved machinability, while maintaining the maximum energy product $(BH)_{max}$.

One embodiment of the present invention comprises sintered RE-Fe—B-type rare earth permanent magnets, with improved fracture toughness and machinability, in a high maximum energy product.

Another embodiment of the present invention comprises sintered RE-Fe—B-type rare earth permanent magnets with optimized magnetic properties, with reduced brittleness.

A further embodiment of the present invention comprises sintered RE-Fe—B-type rare earth permanent magnets with compositional modifications that maximize fracture toughness and improve machinability while maintaining a high maximum energy product.

More specifically, the improved RE-Fe—B-type rare earth permanent magnets of the present invention comprise modified compositions in which an increase of the Nd level and/or the addition of a small amount of Cu, Ti, Nb, and mixtures thereof, provide the properties defined herein. Especially preferred compositional modifications are represented as follows:

(a) $Nd_wFe_{94-w}B_6$, wherein:
w has a value between about 17 and about 22;
(b) $Nd_{16}Fe_{78-x}Ti_xB_6$, wherein:
x has a value between about 0.78 and about 2.34;
(c) $Nd_{16}Fe_{78-y}Nb_yB_6$, wherein:
y has a value between about 1.56 and about 2.34; and
(d) $Nd_{16}Fe_{78-z}Cu_zB_6$, wherein:
z has a value between about 0.78 and about 1.56

It has been found that the compositionally modified sintered RE-Fe—B-type rare earth permanent magnets of the present invention achieve substantial improvement in fracture toughness, i.e. by up to about a 76% increase, while substantially maintaining maximum energy product.

Preferred embodiments comprise a class of sintered rare earth permanent magnets having improved fracture toughness, suitable for conventional machining and drilling, having a general formula selected from the group consisting of:

(a) $Nd_wFe_{94-w}B_6$,
wherein: w has a value between about 16 and about 22;
(b) $Nd_{16}Fe_{78-x}Ti_xB_6$, wherein:
x has a value between about 0.78 and about 2.34;
(c) $Nd_{16}Fe_{78-y}Nb_yB_6$, wherein:
y has a value between about 1.56 and about 2.34; and
(d) $Nd_{16}Fe_{78-z}Cu_zB_6$, wherein:
z has a value between about 0.78 and about 1.56;

wherein said rare earth permanent magnet maintains high maximum energy product of at least about 30 MGOe, while showing an improved fracture toughness over conventional sintered Nd—Fe—B rare earth permanent magnets from between about 6% and about 74%.

Another preferred embodiment of this invention comprises improved sintered rare earth permanent magnets having the formula, RE-Fe—B, where the improvement comprises modifying said formula to one of the formulas selected from the group consisting of:

(a) $Nd_wFe_{94-w}B_6$, wherein:
w has a value between about 14 and about 25;
(b) $Nd_{16}Fe_{78-x}Ti_xB_6$, wherein:
x has a value between about 0.02 and about 2.34;
(c) $Nd_{16}Fe_{78-y}Nb_yB_6$, wherein:
y has a value between about 0.02 and about 2.34; and
(d) $Nd_{16}Fe_{78-z}Cu_zB_6$, wherein:
z has a value between about 0.02 and about 1.56;

wherein said rare earth permanent magnet maintains high energy product, while showing an improved fracture toughness over conventional sintered Nd—Fe—B rare earth permanent magnets from between about 6% and about 74%.

Specific preferred formulas for the rare earth permanent magnets of the present invention include those selected from the group consisting of:

$Nd_{16}Fe_{78}B_6$,
$Nd_{17}Fe_{77}B_6$,
$Nd_{18}Fe_{76}B_6$,
$Nd_{19}Fe_{75}B_6$,
$Nd_{20}Fe_{74}B_6$,
$Nd_{21}Fe_{73}B_6$,
$Nd_{22}Fe_{72}B_6$, and
$Nd_{23}Fe_{71}B_6$.

Additional specific preferred formulas for the rare earth permanent magnets of the present invention include those selected from the group consisting of:

$Nd_{16}Fe_{77.22}Ti_{0.78}B_6$,
$Nd_{16}Fe_{76.44}Ti_{1.56}B_6$,
$Nd_{16}Fe_{75.66}Ti_{2.34}B_6$, and
$Nd_{16}Fe_{74.88}Ti_{3.12}B_6$.

Additional specific preferred formulas for the rare earth permanent magnets of the present invention include those selected from the group consisting of:

$Nd_{16}Fe_{77.22}Nb_{0.78}B_6$,
$Nd_{16}Fe_{76.44}Nb_{1.56}B_6$,
$Nd_{16}Fe_{75.66}Nb_{2.34}B_6$, and
$Nd_{16}Fe_{74.88}Nb_{3.12}B_6$.

Further specific preferred formulas for the rare earth permanent magnets of the present invention include those selected from the group consisting of:

$Nd_{16}Fe_{77.22}Cu_{0.78}B_6$,
$Nd_{16}Fe_{76.44}Cu_{1.56}B_6$,
$Nd_{16}Fe_{75.66}Cu_{2.34}B_6$, and
$Nd_{16}Fe_{74.88}Cu_{3.12}B_6$.

Another preferred embodiment of the present invention comprises a class of rare earth permanent magnets having the following general formula:

$$R_{100-m}TM_mA_n$$

wherein R is one or a mixture of rare earths or yttrium, TM is one or a mixture of transition metals, A is one or a mixture of the following elements: Be, B, C, Mg, Al, Si, P, Ga, Ge, As, Se, In, Sn, Sb, Te, I, Pb, and Bi, and m=80–92, n=0–20; and wherein the magnets comprise a main phase and one or more minor phases, wherein the composition of the main phase is expressed as:

$$R_{100-f}TM_fA_v,$$

in which R is one or a mixture of rare earths or yttrium, TM is one or a mixture of transition metals, A is one or a mixture of the following elements: Be, B, C, Mg, Al, Si, P, Ga, Ge, As, Se, In, Sn, Sb, Te, I, Pb, and Bi, and f=75–90, v=0–20; and wherein the minor phase or phases are rich in transition metal(s) and their composition is expressed as:

$$R_{100-q}TM_qA_p,$$

where R is one or a mixture of rare earths or yttrium, TM is one or a mixture of transition metals, A is one or a mixture of the following elements: Be, B, C, Mg, Al, Si, P, Ga, Ge, As, Se, In, Sn, Sb, Te, I, Pb, and Bi, and q=85–100, p=0–20; and wherein the total atomic percentage of transition metals, TM, in the soft minor phases $R_{100-q}TM_qA_p$ is more than 85%, and preferably more than 90%. Advantageously the minor phase, or the combination of minor phases, have a relatively lower hardness in comparison to the main phase. Therefore, more energy is needed to break the magnet that contains one or more relatively soft phases as compared to conventional rare earth permanent magnets.

Advantageously, the rare earth permanent magnets of the present invention possess fracture toughness equal or above 15 ft-lbs/in$^2$, and preferably equal or above 20 ft-lbs/in$^2$ when measured at 20° C. As a comparison, conventional rare earth permanent magnets have fracture toughness lower than 15 ft-lbs/in$^2$ when measured at 20° C.

Advantageously, the rare earth permanent magnets of the present invention have an average grain size smaller than 25 microns, preferably smaller than 15 microns.

The present invention will be further described based on the accompanying drawings, which are presented for illustrative purposes only.

BRIEF DESCRIPTION OF THE DRAWINGS

FIG. 3A shows Type I materials; FIG. 3B shows Type II materials; and FIG. 3C shows Type III materials.

DETAILED DESCRIPTION OF THE PREFERRED EMBODIMENTS

A material's strength and toughness are different physical parameters. For example, high strength usually does not usually lead to good toughness. More specifically, the toughness of a material is defined as the energy, E, needed to break a material. In a plot of stress vs. strain, this energy is equal to the area under the stress-strain curve $$E = \int_0^{\varepsilon f} \sigma \, d\varepsilon$$

where $\epsilon_f$ is the strain at fracture.

Figure 1:
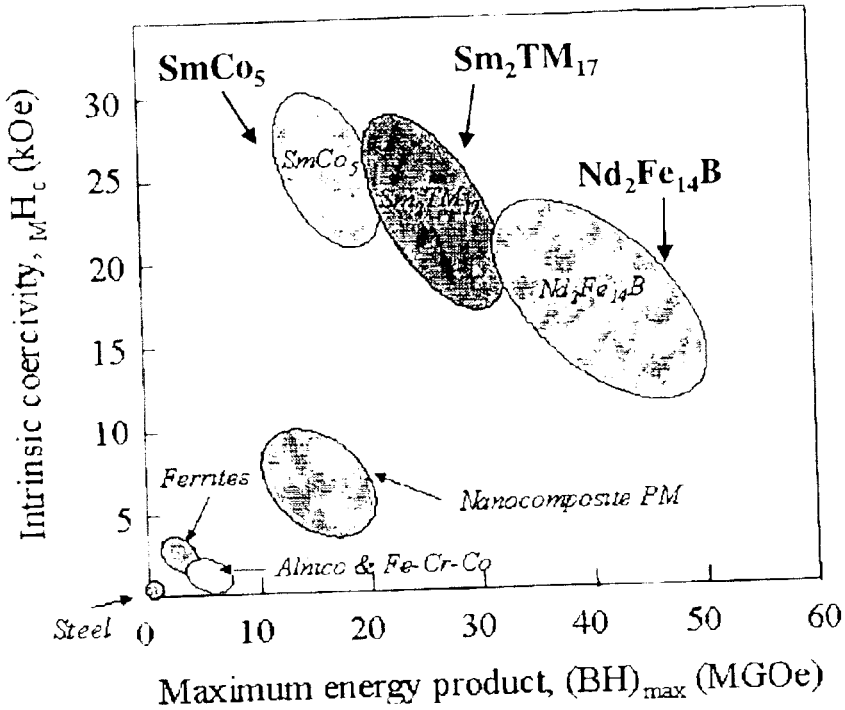
FIG. 1 schematically illustrates the magnetic performance of seven types of commercial rare earth permanent magnets; shown as a plot of intrinsic coercivity versus maximum energy product for permanent magnets.
Figure 2:
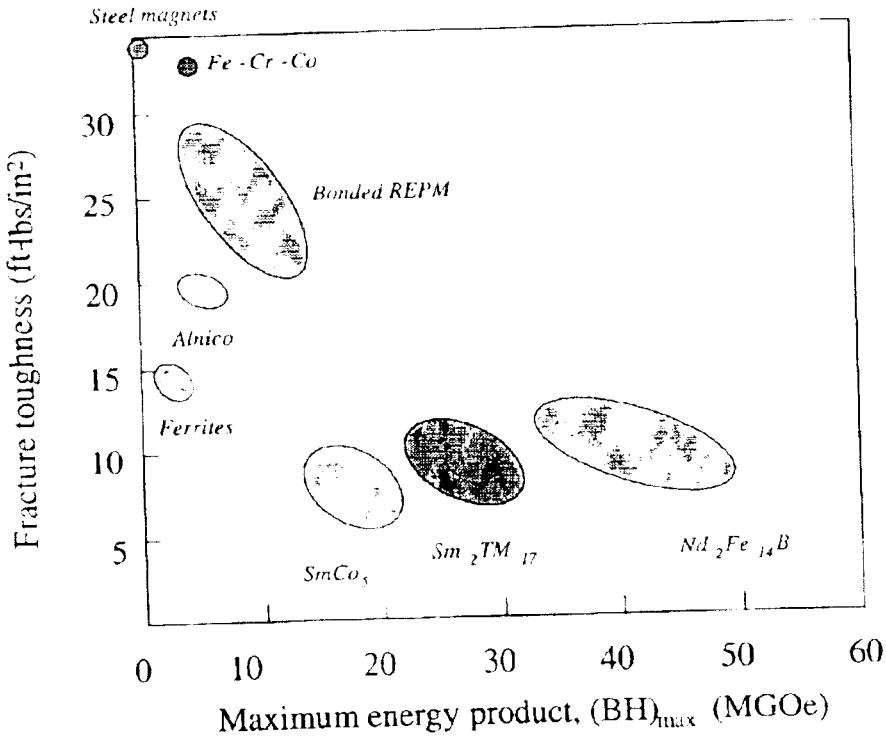
FIG. 2 schematically summarizes the poor fracture toughness of three types of commercial rare earth permanent magnets; shown as a plot of fracture toughness versus maximum energy product for permanent magnets.
Figure 3A:
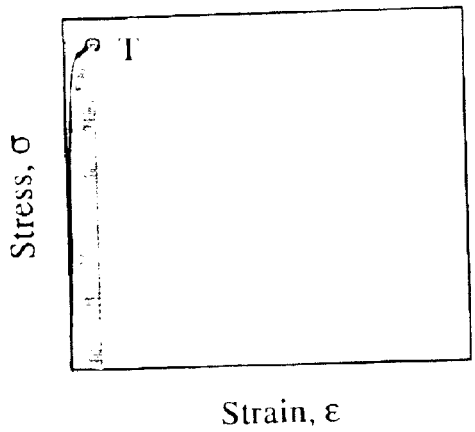
FIGS. 3*a* through 3*c* are illustrative stress-strain curves for different types of materials. Y and T denote yield and tensile strength, respectively.
Figure 3B:
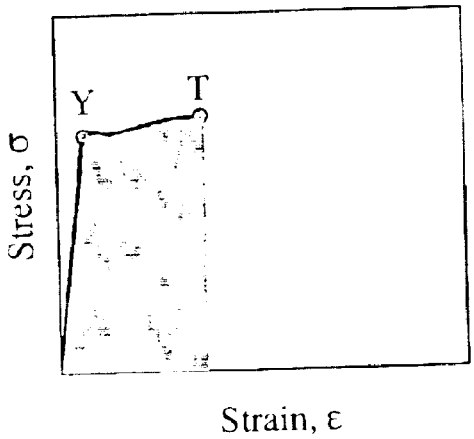
Figure 3C:
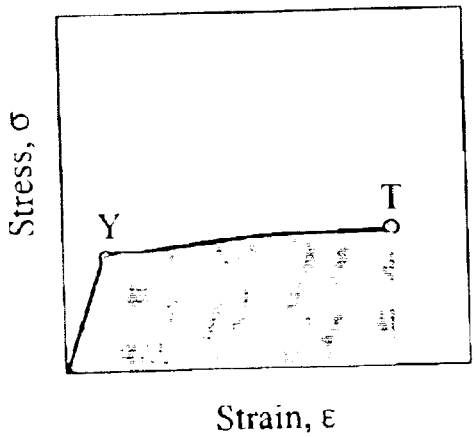

FIGS. 3(*a*) and 3(*b*) of the drawings schematically show stress-strain curves of two types of materials. The Type I materials have high strength but poor toughness, while the Type II materials have low strength but good toughness. Glass and ceramics are typical Type I materials while soft metals, such as Al and Cu, are typical Type II materials. Type I materials tend to be very hard and brittle, with little or even no plastic deformation occurring before fracturing. On the other hand, Type II materials generally indicate good plasticity with low strength. Their toughness is shown in the area under the stress vs. strain curves in FIGS. 3*b* and 3*c*.

Clearly, an increase in strength does not equate to improvement in toughness. More often than not, such an increase in strength would accompany decrease in plasticity, which would lead to decreased toughness. Maximum toughness, therefore, is preferably achieved by optimizing the combination of strength and ductility. In order to obtain a magnet with improved toughness as shown in FIG. 3(*c*) it has been found preferable to not increase strength, but rather to increase ductility (plasticity). The modified RE-Fe—B-type magnets of the present invention generally achieve this increase in ductility via compositional modification as detailed in Tables 2 through 5 and Examples 2 through 22 below.

It is generally agreed that there are three phases in sintered RE-Fe—B-type rare earth permanent magnets: (1) a $RE_2Fe_{14}B$ phase, (2) a RE-rich grain boundary phase, and (3) a B-rich $REFe_4B_4$ phase. Surprisingly, it has been discovered that the toughness of the sintered REFeB magnets of the present invention can surprisingly be enhanced dramatically by modifying these three phases through certain unobvious compositional modifications.

RE-Fe—B-type magnets were compositionally modified by varying Nd content and/or adding Ti, Nb or Cu from the alloys described below by mixing appropriate quantities of different alloys as detailed below:

TABLE 1

| Alloys Prepared by Using a Vacuum Induction Melting Furnace | Alloys prepared by Using a Vacuum Arc Melting Furnace |
|---|---|
| $Nd_{16}Fe_{78}B_6$ | $Nd_{16}Fe_{78}B_6$ |
| $Nd_{60}Fe_{34}B_6$ | $Nd_{60}Fe_{34}B_6$ |
| $Nd_{15}Dy_1Fe_{78}B_6$ | $Nd_{16}Fe_{39}Ti_{39}B_6$ |
| $Nd_{2.4}Pr_{5.6}Dy_1Fe_{85}B_6$ | $Nd_{16}Fe_{39}Nb_{39}B_6$ |
| | $Nd_{16}Fe_{39}Cu_{39}B_6$ |

The Group #1 and #2 alloys described below were prepared using conventional powder metallurgy, without adjusting parameters to optimize magnetic properties. Each was prepared following the steps set out below:

Step 1—A jaw crusher and a double roller crusher were used to crush the ingot,

Step 2—Ball milling was used to reduce the crushed particles to ~5 $\mu$m powder, Step 3—This ~5 $\mu$m powder was compacted using an isostatic press at 3 ton/cm$^3$, Step 4—The compacted powder was sintered at 1080° C. for 20 minutes in a high vacuum followed by exposure to Ar for 40 minutes, and Step 5—The sintered magnet underwent post sintering heat treatment at 650° C. for 20 minutes.

Group #1 alloys include:

$Nd_{16}Fe_{78}B_6$
$Nd_{17}Fe_{77}B_6$
$Nd_{18}Fe_{76}B_6$
$Nd_{19}Fe_{75}B_6$
$Nd_{20}Fe_{74}B_6$
$Nd_{21}Fe_{73}B_6$
$Nd_{22}Fe_{72}B_6$
$Nd_{23}Fe_{71}B_6$
$Nd_{16}Dy_1Fe_{78}B_6$

Figure 5:
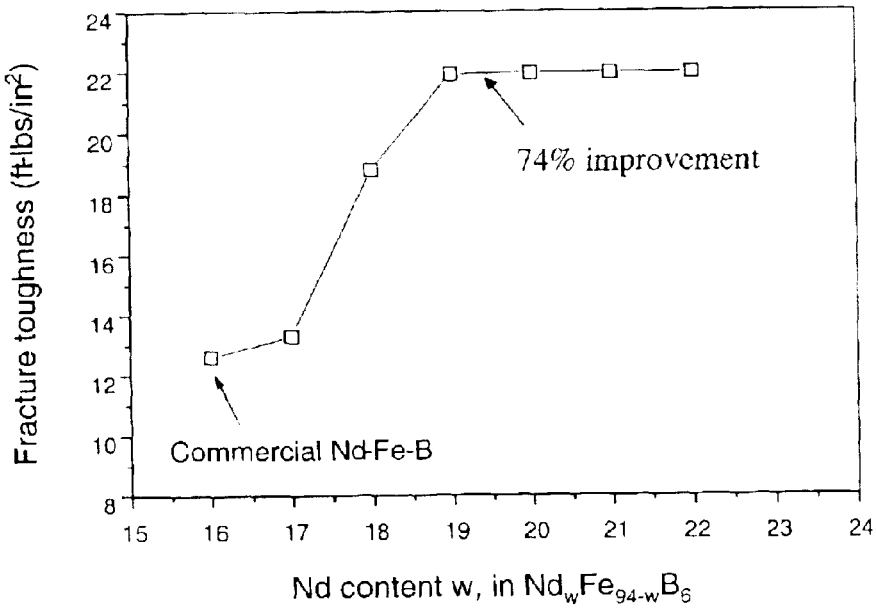
FIGS. 5 through 8 indicate the effect various levels of Nd, Ti, Nb and Cu, respectively, have on the fracture toughness of various RE-Fe—B-type rare earth permanent magnets.

Group #2 alloys include:

$Nd_{16}(Fe_{1-x}Ti_x)_{78}B_6$ with x=0.01, 0.02, 0.03, and 0.04
$Nd_{16}Fe_{77.22}Ti_{0.78}B_6$
$Nd_{16}Fe_{76.44}Ti_{1.56}B_6$
$Nd_{16}Fe_{75.66}Ti_{2.34}B_6$
$Nd_{16}Fe_{74.88}Ti_{3.12}B_6$
$Nd_{16}(Fe_{1-x}Nb_x)_{78}B_6$ with x=0.01, 0.02, 0.03, and 0.04
$Nd_{16}Fe_{77.22}Nb_{0.78}B_6$
$Nd_{16}Fe_{76.44}Nb_{1.56}B_6$
$Nd_{16}Fe_{75.66}Nb_{2.34}B_6$
$Nd_{16}Fe_{74.88}Nb_{3.12}B_6$
$Nd_{16}(Fe_{1-x}Cu_x)_{78}B_6$ with x=0.01, 0.02, 0.03, and 0.04
$Nd_{16}Fe_{77.22}Cui_{0.78}B_6$
$Nd_{16}Fe_{76.44}Cu_{1.56}B_6$
$Nd_{16}Fe_{75.66}Cu_{2.34}B_6$
$Nd_{16}Fe_{74.88}Cu_{3.12}B_6$ Examples of four such modifications and the unexpected and surprising fracture toughness results associated with these modifications are detailed below:

(1) The effect of Nd content on the toughness of sintered RE-Fe—B-type rare earth permanent magnets of the invention is set out in Table 2 and FIG. 5.

Figure 6:
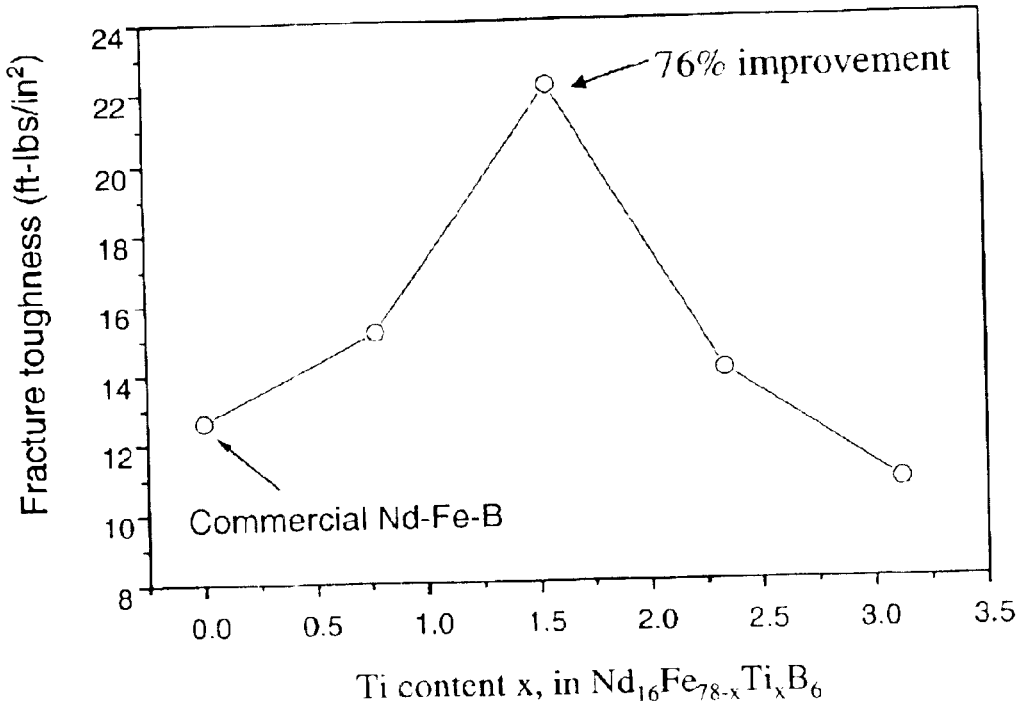

(2) The effect of Ti addition on the toughness of sintered RE-Fe—B-type rare earth permanent magnets of the invention is set out in Table 3 and FIG. 6.

Figure 7:
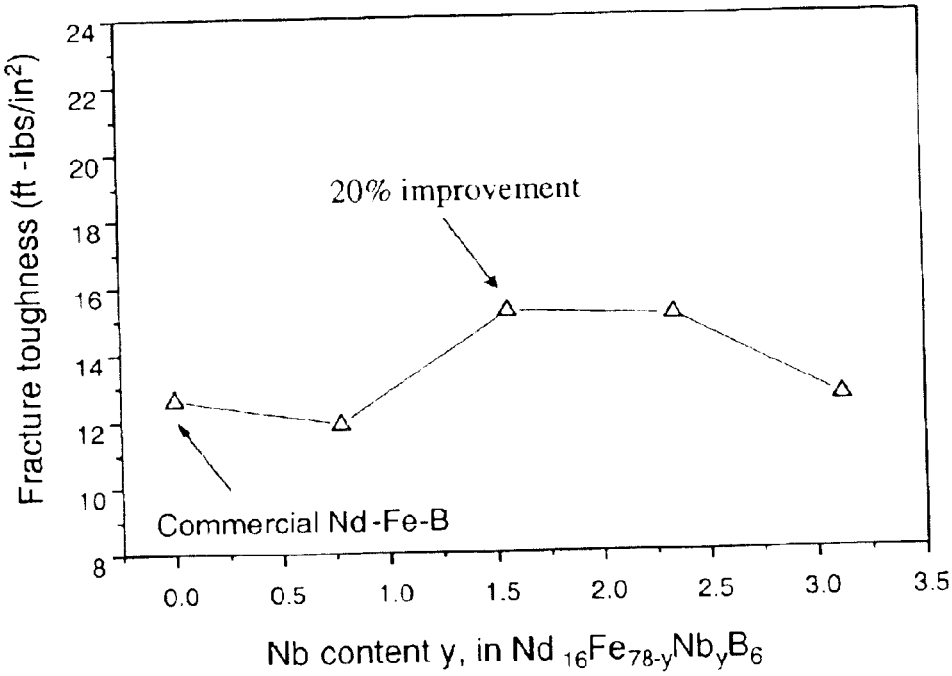

(3) The effect of Nb addition on the toughness of sintered RE-Fe—B-type rare earth permanent magnets of the invention is set out in Table 4 and FIG. 7.

Figure 8:
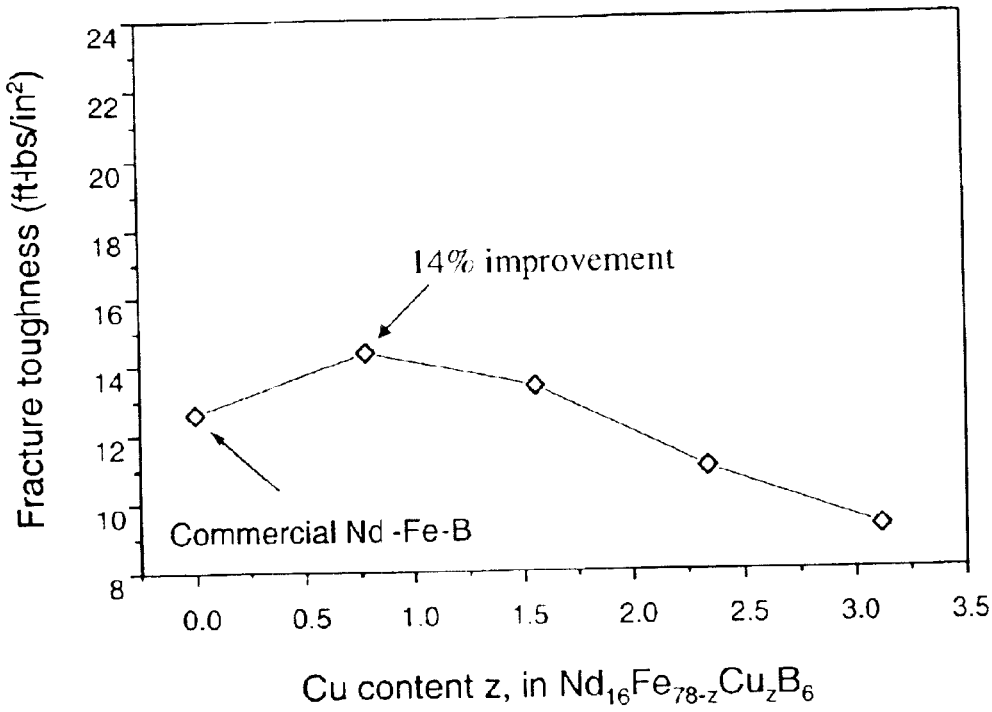
Figure 9:
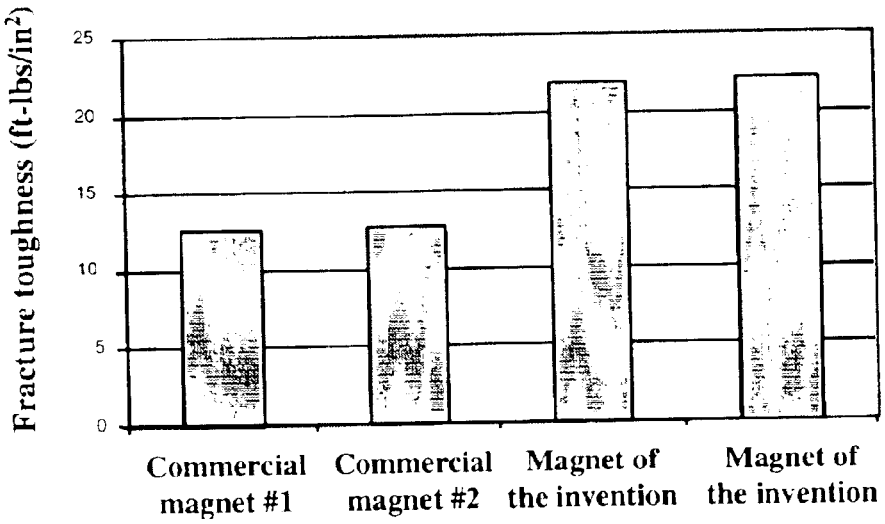
FIG. 9 compares the fracture toughness of two compositionally modified rare earth permanent magnets of the present invention against two commercial rare earth permanent magnets.
Figure 10:
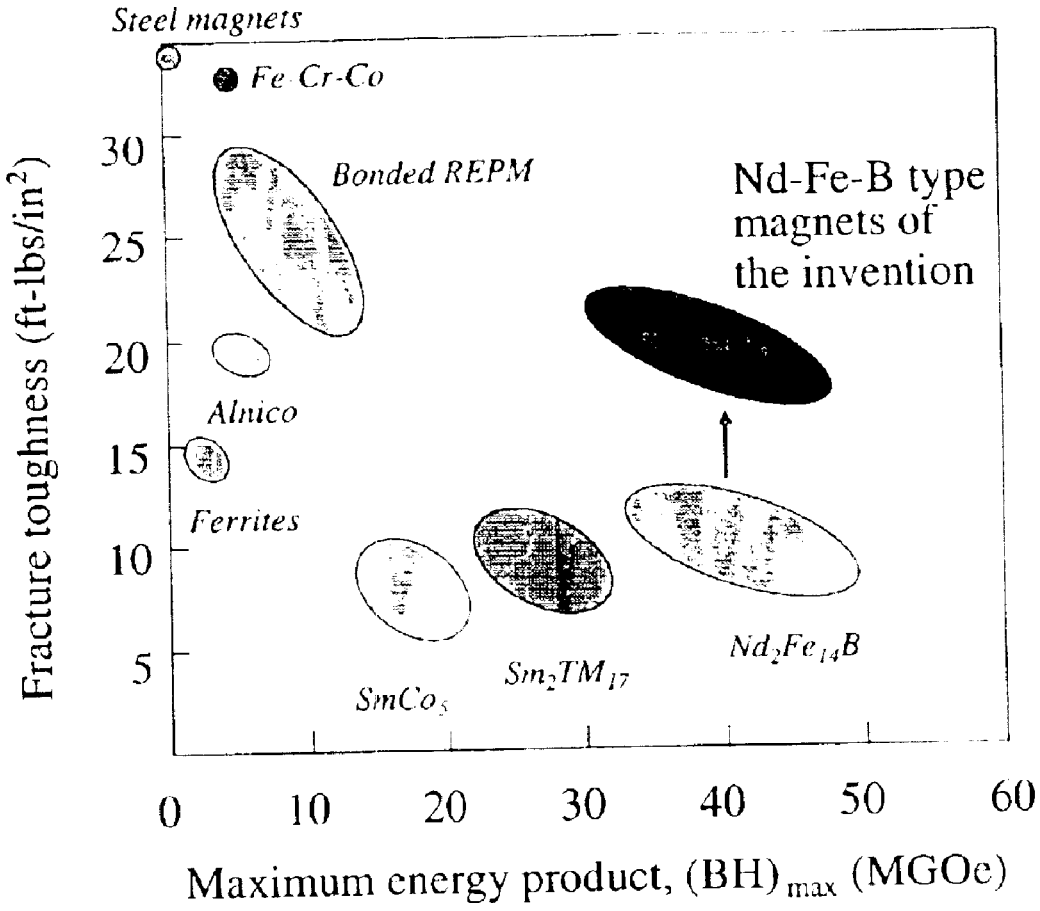
FIG. 10 illustrates how the rare earth permanent magnets of the present invention compare to commercial magnets with respect to fracture toughness; shown as a plot of fracture toughness versus maximum energy product for permanent magnets.
Figure 11:
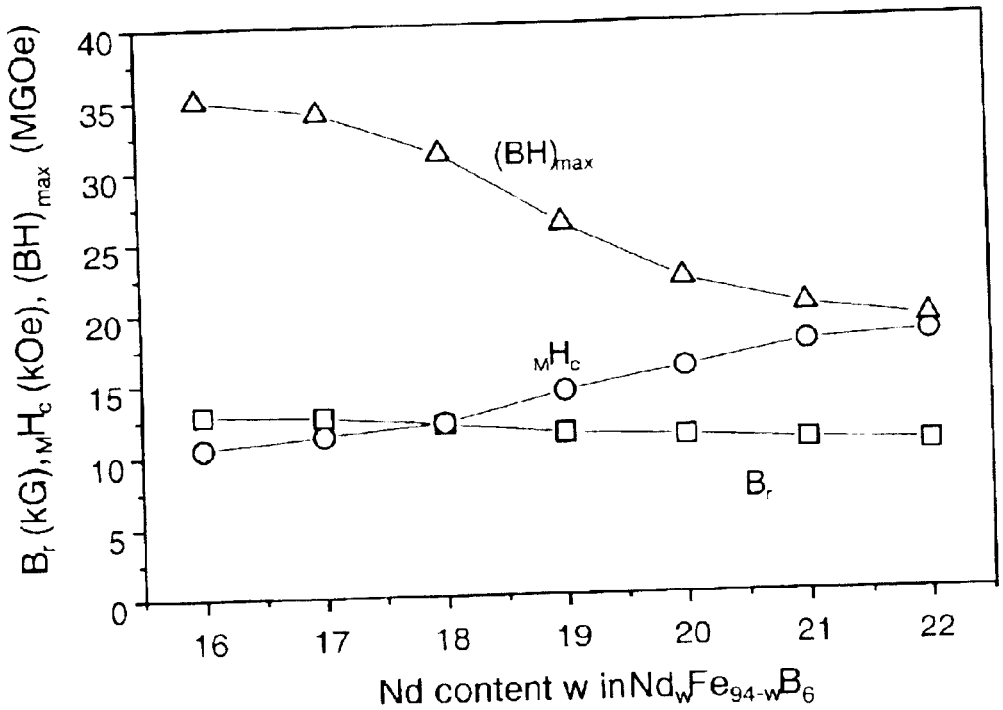
FIGS. 11 through 14 illustrate magnetic properties of various rare earth permanent magnets of the present invention. Although the magnetic properties have not been optimized yet, the trend of property variation versus composition modification can be clearly seen.
Figure 12:
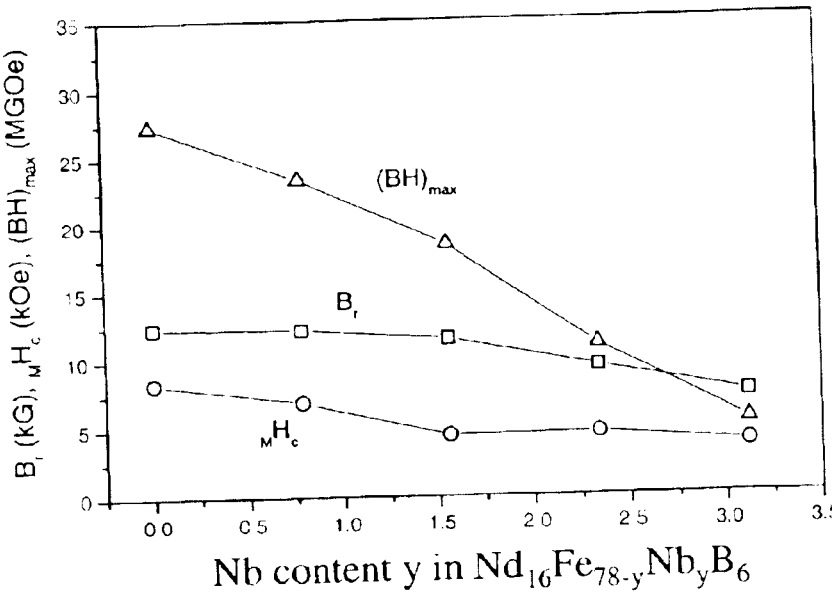
Figure 13:
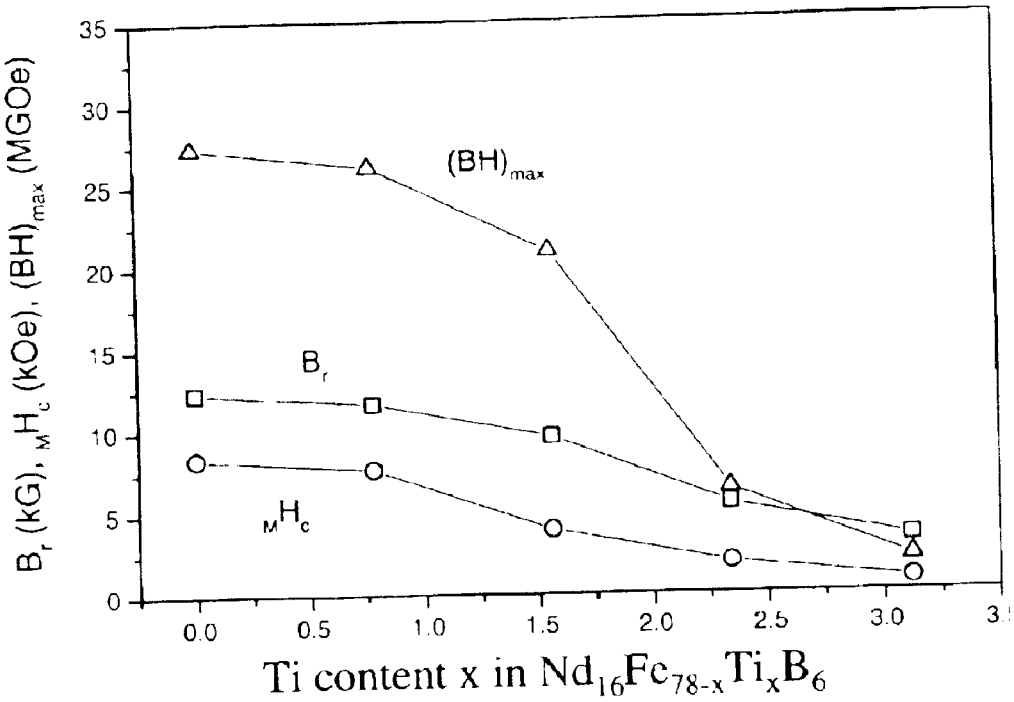
Figure 14:
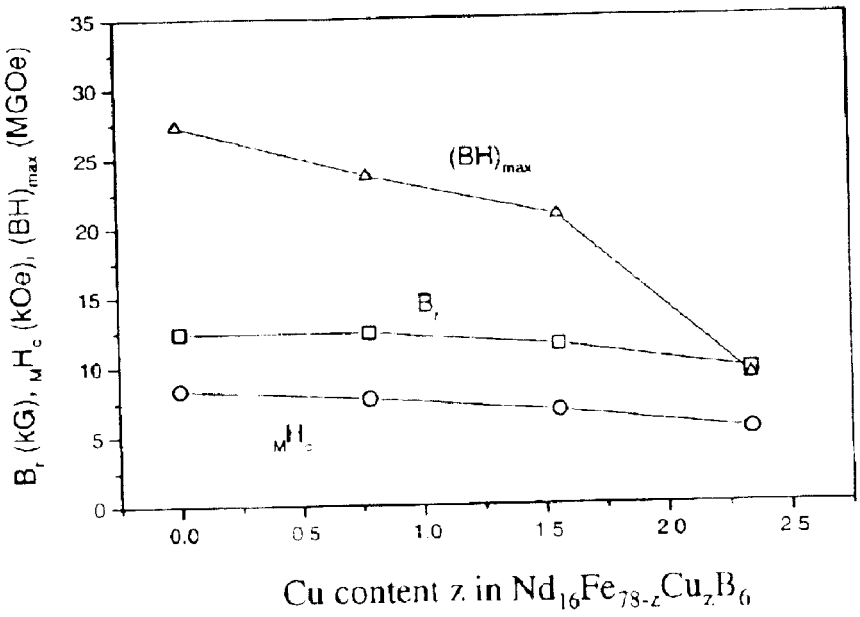

(4) The effect of Cu addition on the toughness of sintered RE-Fe—B-type rare earth permanent magnets of the inventions set out in Table 5 and FIG. 8.

Figure 4:
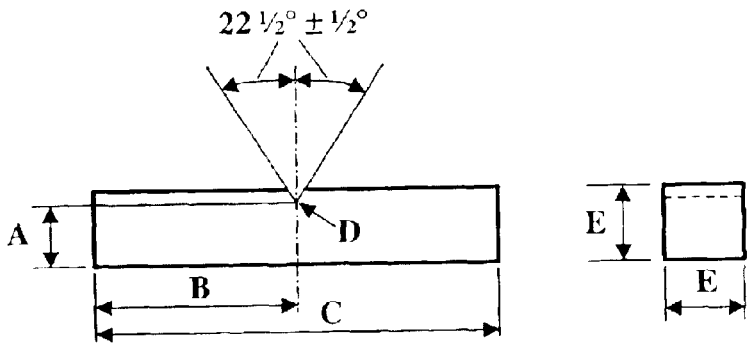
FIG. 4 illustrates a Charpy impact testing specimen with specific dimensions.

The toughness of the various modified RE-Fe—B-type magnets of the invention was determined at room temperature (20°) using a standard Charpy impact testing method with a Bell Laboratories Type Impact Testing Machine. The energy required to break the impact specimen can be readily determined in the test. For the purposes of the present invention, this energy divided by the area at the notch, is defined as the fracture toughness. Fracture toughness describes the toughness of the material tested, as that term is used throughout this specification. The dimensions of the specimens used are detailed in FIG. 4. The effect of the Nd modification to the composition on the fracture toughness of the sintered REFeB magnets is detailed in Table 2 and FIG. 5.

TABLE 2

Effect of Nd Compositional Modification on the Fracture Toughness of Sintered RE-Fe—B-Type Rare Earth Permanent Magnets of the Present Invention

| Example # | Specific Composition | Energy Absorbed (ft-lbs) | Fracture Toughness (ft-lbs/in$^2$) | Percent Increase in Fracture Toughness (in %) | Observation |
|---|---|---|---|---|---|
| 1* | $Nd_{16}Fe_{78}B_6$ | 1.0148 | 12.606 | N/A | |
| 2 | $Nd_{17}Fe_{77}B_6$ | 1.0711 | 13.306 | 6 | |
| 3 | $Nd_{18}Fe_{76}B_6$ | 1.5150 | 18.820 | 49 | |
| 4 | $Nd_{19}Fe_{75}B_6$ | 1.7647 | 21.922 | 74 | |
| 7 | $Nd_{20}Fe_{74}B_6$ | 1.7678 | 21.960 | 74 | |

TABLE 2-continued

Effect of Nd Compositional Modification on the Fracture Toughness of Sintered RE-Fe—B-Type Rare Earth Permanent Magnets of the Present Invention

| Example # | Specific Composition | Energy Absorbed (ft-lbs) | Fracture Toughness (ft-lbs/in$^2$) | Percent Increase in Fracture Toughness (in %) | Observation |
|---|---|---|---|---|---|
| 8 | $Nd_{21}Fe_{73}B_6$ | 1.7678 | 21.960 | 74 | |
| 9 | $Nd_{22}Fe_{72}B_6$ | 1.7689 | 21.974 | 74 | |

*Example 1 is a commercial Nd—Fe—B magnet used to establish baseline.

It can be seen from Table 2 that the toughness of the various sintered Nd—Fe—B-type rare earth permanent magnets is responsive to the Nd content in magnet alloy. The fracture toughness of $Nd_{16}Fe_{78}B_6$ is 12.606 ft-lbs/in$^2$. This value represents the toughness of typical commercial sintered Nd—Fe—B-type magnets. It is apparent from FIG. 5 that the fracture toughness toughness) sharply increases by increasing the Nd content up to 19%. Surprisingly, the 19% level further increases of the Nd content do not materially affect the fracture toughness of the various modified Nd—Fe—B-type magnets.

The fracture toughness of $Nd_{19}Fe_{75}B_6$ (Example #4), 21.922 ft-lbs/in$^2$,is unexpectedly 74% higher than a typical commercial sintered Nd—Fe—B-type magnet represented by $Nd_{16}Fe_{78}B_6$. Surprisingly such a low Nd level (19%) is required to achieve improved toughness of sintered modified Nd—Fe—B magnets.

Table 3 lists data on the effect of Ti addition on toughness (fracture toughness) for various sintered Nd—Fe—B magnets based on the Charpy impact test. The results are also shown in FIG. 6. It can be seen from FIG. 6 that the toughness of sintered Nd—Fe—B magnets sharply increases by increasing Ti content. The toughness reaches a peak of 22.124 ft-lbs/in$^2$ at 1.56% Ti and then unexpectedly decreases. It should be mentioned that Example #13 ($Nd_{16}Fe_{75.66}Ti_{2.34}B_6$) was cut with two notches accidentally. Therefore, the fracture toughness value for Example #13 is not accurate and may actually be much higher than reported.

TABLE 3

Effect of Ti Composition Modification on the fracture toughness of Sintered RE-Fe—B-type Rare Earth Permanent Magnets of the Invention

| Example # | Specific Composition | Energy Absorbed (ft-lbs) | Fracture toughness (ft-lbs/in$^2$) | Increase in Fracture Toughness (in %) | Observation |
|---|---|---|---|---|---|
| 1* | $Nd_{16}Fe_{78}B_6$ | 1.0148 | 12.606 | N/A | Baseline |
| 11 | $Nd_{16}Fe_{77.22}Ti_{0.78}B_6$ | 1.2213 | 15.171 | 20 | |
| 12 | $Nd_{16}Fe_{76.44}Ti_{1.56}B_6$ | 1.7810 | 22.124 | 76 | |
| 13 | $Nd_{16}Fe_{75.66}Ti_{2.34}B_6$ | 1.1276 | 14.007 | 11 | Double notches |
| 14 | $Nd_{16}Fe_{74.88}Ti_{3.12}B_6$ | 0.8687 | 10.791 | −14 | |

*Example #1 is a commercial Nd—Fe—B magnet.

Similar to Ti, Nb has been observed to be another element useful for grain refinement. The effect of Nb addition on toughness of various sintered Nd—Fe—B magnets is set out in Table 4 and FIG. 7. It can be concluded from FIG. 7 that the Nb addition also improves toughness of various sintered Nd—Fe—B-type magnets. A peak fracture toughness of 15.171 ft-lbs/in$^2$ is reached at 1.56%. Apparently, the effect of Nb on the toughness of various Nd—Fe—B magnets is not as great as Ti.

TABLE 4

Effect of Nb Composition Modification on the Fracture Toughness of Sintered RE-Fe—B-type Rare Earth Permanent Magnets of the Invention

| Example # | Specific Composition | Energy Absorbed (ft-lbs) | Fracture Toughness (ft-lbs/in$^2$) | Percent Increase in Fracture Toughness (in %) | Observation |
|---|---|---|---|---|---|
| 1* | $Nd_{16}Fe_{78}B_6$ | 1.0148 | 12.606 | N/A | Baseline |
| 15 | $Nd_{16}Fe_{77.22}Nb_{0.78}B_6$ | 0.9572 | 11.891 | −6 | |
| 16 | $Nd_{16}Fe_{76.44}Nb_{1.56}B_6$ | 1.2213 | 15.171 | 20 | |
| 17 | $Nd_{16}Fe_{75.66}Nb_{2.34}B_6$ | 1.2112 | 15.046 | 19 | |
| 18 | $Nd_{16}Fe_{74.88}Nb_{3.12}B_6$ | 1.0098 | 12.544 | 0 | |

*Example #1 is a commercial Nd—Fe—B magnet.

The effect of Cu on room temperature fracture toughness of various sintered Nd—Fe—B magnets is-shown in Table 5 and FIG. 8. It is seen from FIG. 8 that adding Cu to various Nd—Fe—B magnet compositions slightly improves room-temperature toughness of various sintered Nd—Fe—B magnets. Fracture toughness peaks at 14.359 ft-lbs/in$^2$ with 0.78% Cu.

TABLE 5

Effect of Cu Composition Modification on the Fracture Toughness of Sintered RE-Fe—B-type Rare Earth Permanent Magnets of the Invention

| Example # | Composition | Energy Absorbed (ft-lbs) | Fracture Toughness (ft-lbs/in$^2$) | Percent Increase in Fracture Toughness (in %) | Observation |
|---|---|---|---|---|---|
| 1* | $Nd_{16}Fe_{78}B_6$ | 1.0148 | 12.606 | N/A | Baseline |
| 19 | $Nd_{16}Fe_{77.22}Cu_{0.78}B_6$ | 1.1559 | 14.359 | 14 | |
| 20 | $Nd_{16}Fe_{76.44}Cu_{1.56}B_6$ | 1.0751 | 13.355 | 6 | |
| 21 | $Nd_{16}Fe_{75.66}Cu_{2.34}B_6$ | 0.8838 | 10.979 | −13 | |
| 22 | $Nd_{16}Fe_{74.88}Cu_{3.12}B_6$ | 0.7426 | 9.225 | −27 | |

*Example #1 is a commercial Nd—Fe—B magnet.

The foregoing establishes that modifying the RE-Fe—B-type magnet compositions with Nb, Cu, and especially Ti, or Nd effectively improves the room temperature fracture toughness of sintered RE-Fe—B-type magnets. Exceptional and unexpected high fracture toughness of 22.124 ft-lbs/in$^2$ and 21.922 ft-lbs/in$^2$ were obtained for $Nd_{16}Fe_{76.44}Ti_{1.56}B_6$ and $Nd_{19}Fe_{75}B_6$, respectively. These represent a 74 to 76% improvement of the toughness vis-à-vis commercial sintered Nd—Fe—B-type magnets.

It was found that grain refinement plays an important role in increasing toughness. When grain size is smaller than 25 microns, especially smaller than 12 microns, the fracture toughness increases significantly. We concluded that the smaller the grain size, the better the fracture toughness providing for magnets with the same composition.

Additional minor phases were found in the magnets of the present invention, which has been found to be a very important feature of the invention.

The Nd-rich phases are predominantly along grain boundaries. Some larger Nd-riches phases are also located inside the grains or at the triple grain boundary junctions. These mechanically soft Nd-rich phases help decrease the brittleness, and therefore increase the fracture toughness of the sintered NdFeB magnets of the invention.

Figure 15:
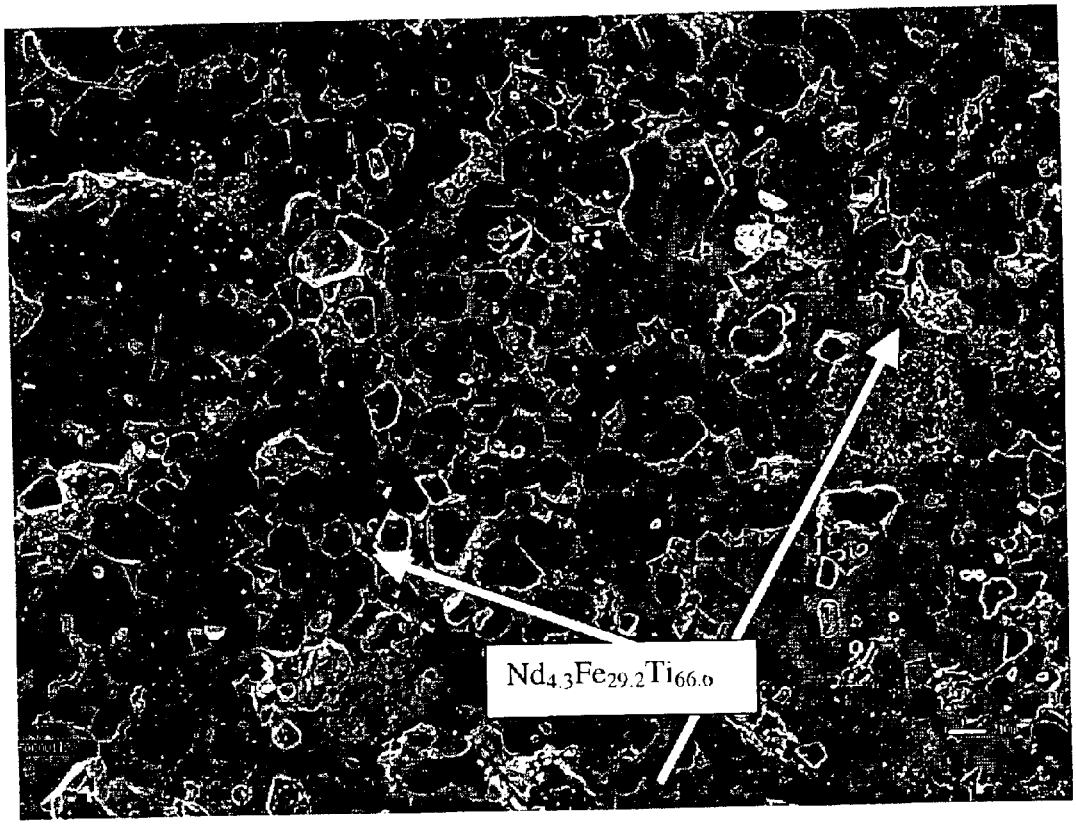
FIG. 15 is a SEM micrograph of $Nd_{16}Fe_{76.44}Ti_{1.56}B_6$ magnets of the invention showing the $Nd_2Fe_{14}B$ main phase and the Ti-rich phase

Ti-rich minor phases with a composition close to $Nd_{4.3}Fe_{29.2}Ti_{66.5}$ were identified in the $Nd_{16}Fe_{76.44}Ti_{1.56}B_6$ sintered magnets of the invention. These Ti-rich minor phases have excellent toughness due to the amount of transition metals, Fe and Ti, which account for more than 90 atomic percent. The existence of the soft Ti-rich minor phases are the key for the toughness improvement of the Ti added NdFeB magnets of the invention. An example of the microstructure showing the main phase and the Ti-rich minor phases is given in FIG. 15.

By using scanning electron microscope (SEM) and X-Ray analysis, similar minor phases were also identified in the Nb and Cu added NdFeB magnets of the invention. These minor phases generally have low Nd content (<10 atomic %) and high Fe and other transition metal content (>90 atomic %). All these minor TM-rich phases have excellent plasticity and low hardness as compared to the main $Nd_2Fe_{14}B$ phase. The amount and morphology of these minor phases have a great impact to the toughness enhancement of the sintered NdFeB-type magnets of the invention.

Figure 16:
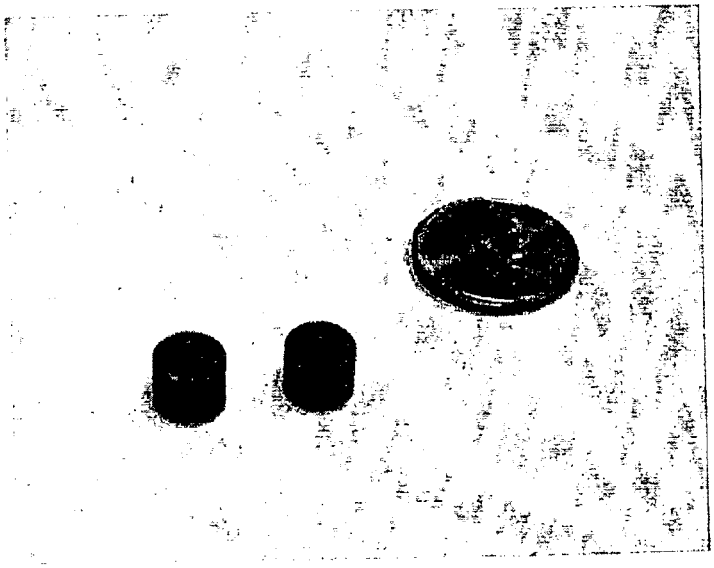
FIG. 16 shows the sintered NdFeB magnets of the invention were machined by conventional cutting and drilling, which is impossible for commercial sintered NdFeB magnets.

As shown in FIG. 16, sintered NdFeB-type magnets of the invention can be machined by conventional cutting and drilling, which is impossible for the commercial sintered NdFeB-type magnets.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A class of sintered rare earth permanent magnets having improved fracture toughness, said magnets having the general formula:

(a) $Nd_wFe_{94-w}B_6$, wherein:

w has a value between 18 and 22;

said class of magnets having a maximum energy product of at least about 30 MGOe and a room temperature fracture toughness from 13.3 ft-lbs/in$^2$ to 22.1 ft-lbs/in$^2$.

2. Rare earth permanent magnets according to claim 1, wherein said magnets represented by $Nd_wFe_{94-w}B_6$ are selected from the group consisting of:

$Nd_{18}Fe_{76}B_6$, $Nd_{19}Fe_{75}B_6$, $Nd_{20}Fe_{74}B_6$, $Nd_{21}Fe_{73}B_6$, and $Nd_{22}Fe_{72}B_6$.

3. Rare earth permanent magnets as described in claim 1 having a room temperature fracture toughness equal to or greater than 15 ft-lbs/in$^2$.

4. Rare earth permanent magnets as described in claim 1 having a room temperature fracture toughness equal to or greater than 20 ft-lbs/in$^2$.

5. Rare earth permanent magnets as described in claim 1 having an average grain size smaller than 25 microns.

6. Rare earth permanent magnets as described in claim 1 having an average grain size smaller than 15 microns.

* * * * *